US006588170B2

(12) United States Patent
Simpson et al.

(10) Patent No.: US 6,588,170 B2
(45) Date of Patent: Jul. 8, 2003

(54) ZONE BASED ROOFING SYSTEM

(75) Inventors: Harold G. Simpson, Tulsa, OK (US); Leo E. Neyer, Edmond, OK (US); Clarence S. Salisbury, Moore, OK (US)

(73) Assignee: Harold Simpson, Inc., Tulsa, OK (US)

( * ) Notice: Subject to any disclaimer, the term of this patent is extended or adjusted under 35 U.S.C. 154(b) by 0 days.

(21) Appl. No.: 09/775,480

(22) Filed: Feb. 2, 2001

(65) Prior Publication Data

US 2002/0035812 A1 Mar. 28, 2002

Related U.S. Application Data

(60) Provisional application No. 60/180,231, filed on Feb. 4, 2000, and provisional application No. 60/196,496, filed on Apr. 12, 2000.

(51) Int. Cl.[7] ..... E04B 1/08
(52) U.S. Cl. ..... 52/748.1; 52/528; 52/542
(58) Field of Search ..... 52/528, 520, 545, 52/748.1, 749.12, 537, 542

(56) References Cited

U.S. PATENT DOCUMENTS

| | | | | | |
|---|---|---|---|---|---|
| 4,694,628 | A | | 9/1987 | Vondergoltz et al. | 52/528 |
| 4,759,165 | A | * | 7/1988 | Getoor et al. | 52/528 |
| 4,987,716 | A | * | 1/1991 | Boyd | 52/520 |
| 5,001,881 | A | * | 3/1991 | Boyd | 52/545 |
| 5,201,158 | A | | 4/1993 | Bayley et al. | 52/537 |
| 5,247,772 | A | * | 9/1993 | Greenberg | 52/531 |
| 5,259,166 | A | * | 11/1993 | Carey, II et al. | 52/748 |

* cited by examiner

*Primary Examiner*—Carl D. Friedman
*Assistant Examiner*—Naoko Slack
(74) *Attorney, Agent, or Firm*—Fellers, Snider, et al.; Bill D. McCarthy

(57) ABSTRACT

A zone based roofing system for roofing a building, the roof of the building identified by demand zones of the roof, the type of seaming process used for each demand zone varied to connect the standing seams of the panels to meet the minimum requirements of the demand zones. The panels are secured to the roof support structure and adjacently disposed panels are interlocked such as by seaming according to demand zone requirements to achieve demand quality for each zone and thereby minimizing the cost of the roof.

24 Claims, 11 Drawing Sheets

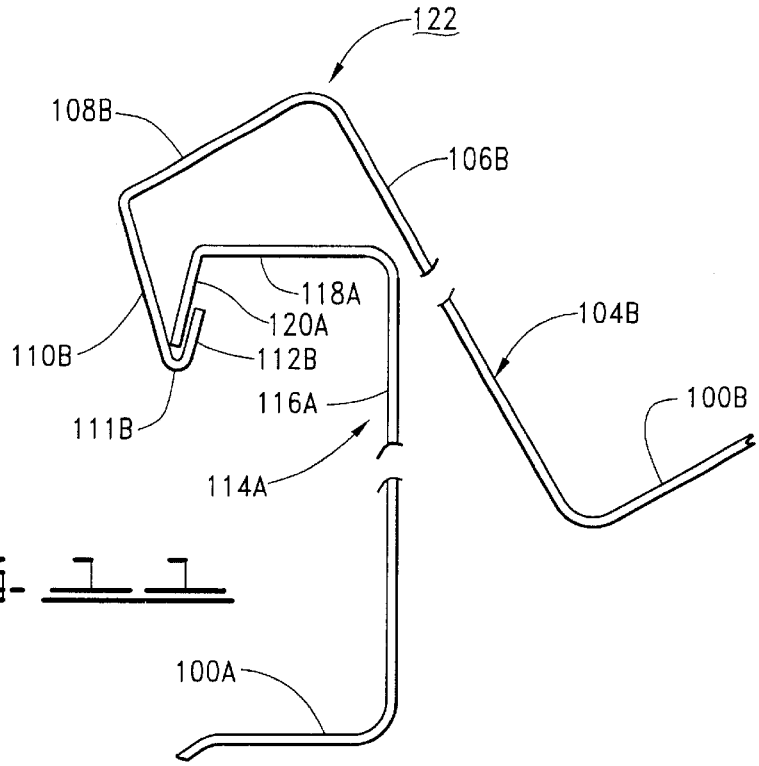
FIG. 11
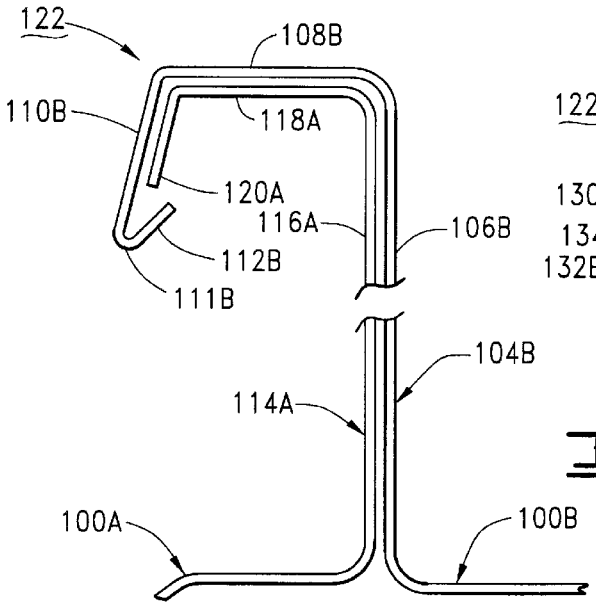
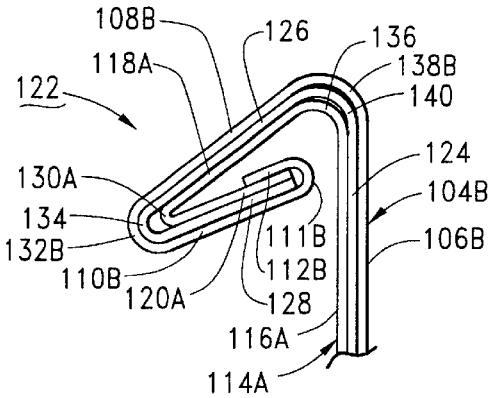
FIG. 14
FIG. 12

| LETTER DESIGNATION FOR TYPE OF SEAM | TYPE OF SEAM |
|---|---|
| A | CONTINUOUS QUADRILOCK SEAM |
| B | COMBINATION QUADRILOCK AND TRIPLE-LOCK SEAM (CONTINUOUS TRIPLE-LOCK SEAMING WITH QUADRILOCK AT CLIPS) |
| C | CONTINUOUS TRIPLE-LOCK SEAM |
| D | COMBINATION ELASTIC-AND-QUADRILOCK SEAM (CONTINUOUS TRIPLE-LOCK SEAMING WITH QUADRILOCK AT CLIPS) |
| E | COMBINATION ELASTIC AND TRIPLE-LOCK SEAM (CONTINUOUS ELASTIC SEAMING WITH TRIPLE-LOCK AT CLIPS) |
| F | ROLL-AND-LOCK SEAM (ELASTIC SEAMING) |

FIG. 16

| COMPOSITE ZONES | WIND ZONE | SEAM | LEAK ZONE | SEAM | SNOWDRIFT ZONE | SEAM | COMPOSITE ZONE |
|---|---|---|---|---|---|---|---|
| FIG. 7 | FIG. 4 | | FIG. 5 | | FIG. 6 | | |
| 601 | 301 | B | 401 | F | 501 | F | B |
| 602 | 302 | C | 401 | F | 501 | F | C |
| 603 | 303 | B | 401 | F | 501 | F | B |
| 604 | 304 | C | 401 | F | 501 | F | C |
| 605 | 305 | F | 401 | F | 501 | F | F |
| | | | | | | | |
| 606 | 306 | C | 401 | F | 501 | F | C |
| 607 | 304 | C | 401 | F | 502 | C | C |
| 608 | 305 | F | 401 | F | 502 | C | C |
| 609 | 306 | C | 401 | F | 502 | C | C |
| 610 | 304 | C | 402 | A | 502 | C | A |
| | | | | | | | |
| 611 | 305 | F | 402 | A | 502 | C | A |
| 612 | 306 | C | 402 | A | 502 | C | A |
| 613 | 307 | B | 402 | A | 502 | C | A |
| 614 | 308 | C | 402 | A | 502 | C | A |
| 615 | 309 | B | 402 | A | 502 | C | A |

FIG. 17

| SEAM | RELATIVE COST LOWEST (1) TO HIGHEST (6) | RELATIVE WIND UPLIFT RESISTANCE LOWEST (1) TO HIGHEST (6) |
|---|---|---|
| ROLL-AND-LOCK (ELASTIC SEAMING) | 1 | 1 |
| COMPINATION ELASTIC-AND-TRIPLE-LOCK (CONTINUOUS ELASTIC SEAMING WITH TRIPLE-LOCK AT CLIPS) | 2 | 2 |
| CONTINUOUS TRIPLE-LOCK | 3 | 3 |
| COMPINATION ELASTIC-AND QUADRILOCK (CONTINUOUS ELASTIC SEAMING WITH QUADRILOCK AT CLIPS) | 4 | 4 |
| COMPINATION TRIPLE-LOCK AND QUADRILOCK (CONTINUOUS TRIPLE-LOCK SEAMING WITH QUADRILOCK AT CLIPS) | 5 | 5 |
| CONTINUOUS QUADRILOCK | 6 | 6 |

FIG. 18

| SEAM | RELATIVE COST LOWEST (1) TO HIGHEST (6) | RELATIVE WATERTIGHTNESS LOWEST (1) TO HIGHEST (6) |
|---|---|---|
| ROLL-AND-LOCK (ELASTIC SEAMING) | 1 | 1 |
| COMPINATION ELASTIC-AND-TRIPLE-LOCK (CONTINUOUS ELASTIC SEAMING WITH TRIPLE-LOCK AT CLIPS) | 2 | 2 |
| CONTINUOUS TRIPLE-LOCK | 3 | 3 |
| COMPINATION ELASTIC-AND QUADRILOCK (CONTINUOUS ELASTIC SEAMING WITH QUADRILOCK AT CLIPS) | 4 | 4 |
| COMPINATION TRIPLE-LOCK-AND-QUADRILOCK (CONTINUOUS TRIPLE-LOCK SEAMING WITH QUADRILOCK AT CLIPS) | 5 | 5 |
| CONTINUOUS QUADRILOCK | 6 | 6 |

FIG. 19

ZONE BASED ROOFING SYSTEM

RELATED APPLICATIONS

The present application claims priority to provisional application No. 60/180,231, filed Feb. 4, 2000 and to provisional application No. 60/196,496 filed Apr. 12, 2000.

BACKGROUND OF THE INVENTION

1. Field of the Invention

The present invention relates to standing seam metal roofs, and more particularly but not by way of limitation, to zone dependent selection and installation of standing seam roofs.

2. Description of the Related Art

Metal panel roofs have become common architectural features for buildings. The metal panel roof is both an aesthetic feature and a functional component of such a building. The roof of a building functions to provide shelter from the natural elements of wind, sun, rain and snow, and to enclose the building interior for environmental control. Numerous types of metal panel roofs have been proposed which resist these natural elements and which allow the metal panels to expand and contract in response to changes in temperature.

The typical support structure for a metal roof includes purlins supported by rafters that rise from an eave to a ridge peak. The purlins are the cross members that typically are interconnected and supported by the rafters to extend the length of the building.

Roofs may be classified as shed roofs and gasket roofs. Shed roofs are roofs that shed water because gravity pulls the water down and away from panel joints more effectively than wind or capillary action propel water through the joint. On the other hand, gasket roofs provide roof joints that are made watertight by placing gasket material between the panel joints and securing the gasket in place by encapsulating the gasket material or exerting pressure upon the gasket material. Generally, low slope gasket roofs may be installed where the roof slope is less than about 1 to 48.

A problem common to all roofs is wind lift caused by wind crossing over a peak creating reduced pressure above the roof, and thus a pressure differential above and below the roof. This pressure differential results in an uplift force on the panels of a metal panel roof, causing the panels to be pulled upwardly and away from the underlying support structure. This is often the primary cause of failure for a metal panel roof.

As known in the art, standing seam roofs have been developed primarily to overcome the problems created by wind uplift, snow, rain and thermal expansion and contraction. Standing seam roof panels have interlocking sidelaps, a female sidelap of each panel engaging and locking a male sidelap of an identical side-adjacent panel. As used herein, the term side-adjacent means that a first panel is adjacent a second panel on the roof. The female sidelap and male sidelap of each panel are elevated, or standing, from a central flat or corrugated medial portion of each panel.

The panels are attached to the support structure of the roof by the use of clips and through-fasteners. Through fasteners, such as sheet metal screws, substantially fix the panels and support structure together so that no differential movement occurs between panels and the support structure. There are two types of clips, fixed clips and sliding clips. Fixed clips are metal devices that attach to the underlying support structure and to the two side-adjacent metal panels at the joint of the interlocking sidelaps of the panels. Sliding clips, also called floating-clips, are attached to the side-adjacent metal panels at the joint of the interlocking sidelaps of the panels and to the underlying support structure in such a way as to permit some differential movement between the panels and the support structure.

The interlocking engagement of the sidelaps of the metal panels provide stiffness and strength to a flexible roof structure. The use of floating clips allows the roof structure to expand and contract as a function of the coefficient of thermal expansion of the panel material, and the temperature cycles of the roof panels.

Several types of seaming processes have been developed for interlocking the sidelaps of adjacently disposed panels. Most such seaming processes involve the operation of inelastically bending or rolling portions of the female sidelap and the male sidelap in a common direction. This inelastic or plastic deformation of the sidelap portions forms interlocked joints, or locks, of varying strength. That is, the interlocked sidelaps can be rolled multiple times so as to increase their resistance against unrolling or unfurling. Generally, the more times the interlocked sidelaps are rolled or plastically deformed, the stronger the lock will be to unfurling. However, stronger locks require a corresponding increase in the cost of manpower and equipment to perform the bending or locking operation.

The quality of a particular area of the roof is a function of the type of seaming perform&d between side-adjacent panels. A standing seam roof of the lowest quality is a roof in which the seam joint formed between adjacent sidelaps of the roof panels is the weakest with respect to wind uplift and is the least watertight. A standing seam roof of the highest quality is a roof in which the seam joint formed between adjacent sidelaps of the roof panels is the strongest with respect to wind uplift and is the most watertight.

In the art, sidelap seaming currently follows the practice of roll seaming adjacent sidelaps from one end of the panels to the other end of the interlocked panels. Only should the seaming machine malfunction is this practice not followed, and in such a case, the seaming is restarted at the point of malfunction and the seaming is completed as much as possible as though the malfunction had not occurred.

Many factors must be considered in the design and selection of a standing seam roof for a specific building. Of primary concern is the roof performance criteria, which may be determined by the geographic location of the building and the typical weather conditions expected during the life of the building. Modem day building codes impose many different requirements for the roof of a building. All such codes include requirements for live loads, dead loads, snow loads, wind loads and earthquake loads.

Further, it is known that different areas or zones of a roof usually experience different loadings. This is especially true with regard to the factor of uplift resulting from a wind blowing over the roof. Also, the quality of watertightness required is often more critical in some portions of a roof than in other portions of the roof, the watertightness being a major concern in the valleys of the roof.

There is also the non-utilitarian, or the aesthetic, aspect of a roof The appearance of a roof is often an important consideration when deciding the kind and amount of seaming necessary for interlocking roof panels. Generally, the less plastic deforming of the panel sidelaps, the more the roof is aesthetically pleasing.

Considering these design factors, it has been the practice in most instances to determine the most critical portion of the roof and to require that all portions of the roof meet the design parameters of the most critical portion of the roof. The result of this approach is that the design specifications for the other less demanding portions of the roof exceed that which is necessary. This approach results in an unnecessary increase in the cost of the roof. Thus, there is a need for a roof that meets the requirements of all zones of the roof, minimizes the cost of the roof and is aesthetically acceptable.

SUMMARY OF THE INVENTION

The present invention provides a metal panel roof that uses different types of seaming in different demand zones of the roof to achieve the required performance at a minimum cost, and a universal panel capable of joinder by multiple seaming options.

A metal panel roof is zone mapped for performance requirements according to the functional performance required for its demand zones. The metal panels are attached to the underlying roof support structure and elastically seamed together by a roll-and-lock seam in accordance with the seaming type assigned to each zone. Next, one determines the minimum quality of seaming that meets the minimum functional performance requirements of the multiple demand zones. Finally, one seams side-adjacent metal. panels together by the minimum quality seam necessary to meet the performance requirements of the multiple demand zones.

An object of the present invention is to provide a zone based roofing system. optimizing the quality of a standing seam roof by roof function zone identification and zone adaptation of the installation process, and a universal panel for such zone based roofing.

Other objects, features and advantages of the present invention will be apparent from the following description of the invention when read in conjunction with the accompanying drawings and claims.

BRIEF DESCRIPTION OF THE DRAWINGS

FIG. 6 is a top view of roof 12B shown in FIG. 1, indicating the snowdrift zones of the roof subject to probable snow buildup and the zones having potential water damming with snow melting.

FIG. 11 is a second elevational end view of the panels of FIG. 8 with the panel assembly progressively continuing.

FIG. 12 is a third elevational end view of the panels of FIG. 8 with the panel assembly progressively continuing.

FIG. 14 is an elevation end view of the panels of FIG. 8 with a clip secured thereto and having been progressively seamed further in accordance with the present invention.

FIG. 16 provides a table showing designation of demand zones for types of seaming.

FIG. 17 provides a table of types of seaming required for wind zones.

FIGS. 18 is a chart showing the relative cost and effectiveness for different seams in response to wind uplift forces.

FIG. 19 is a chart of relative cost and effectiveness for different seams with regard to water tightness.

DESCRIPTION

As mentioned above, many factors must be considered in the design of a commercial grade building, especially when a metal panel, standing seam roof is to be applied. In practice, such design begins with consideration of the geographic location of the building site. For example, it will be appreciated that the building requirements for a standing seam roof to be constructed in a northern location having a great deal of yearly winter precipitation will vary greatly from a standing seam roof in a southern location having only mild winter conditions. For contractors the practice has long been to select building materials, including roofing panels, that meet the most severe conditions that are likely to be encountered by the building. For suppliers, this practice has demanded inventory of stocks of a range of metal building components to meet all such conditions.

The reality of construction design is that, with few exceptions, the design criteria for each geographical area is expressed in Federal, State and local building codes, and all such codes deal with the requirements with such factors as, for example, live and dead loads, snow loads, wind loads and earthquake loads. Considering these design factors, it has been the practice in most instances, once the most critical portions of the roof have been determined, to require that all portions of the roof meet the design parameters of the most critical portion of the roof. The result is that the final design specifications for the other less demanding portions of the roof exceed that which is required. This approach causes an unnecessary increased cost of the roof Thus, there is a need for a roof that meets the requirements of all demand zones of the roof, minimizes the cost of the roof and is aesthetically acceptable. This will be illustrated with reference to the drawings.

Figure 1:
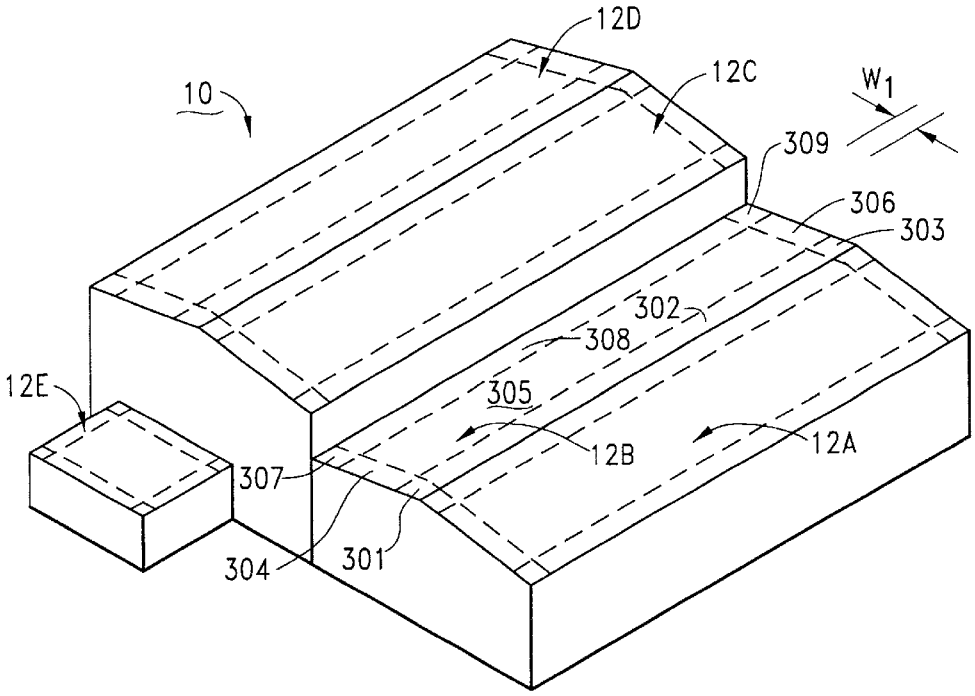
FIG. 1 is a perspective view of a building with a metal panel roof and indicating the physical zones of the roof subjected to varying wind loads.

FIG. 1 shows a typical pre-engineered building 10 having metal panel roofs 12A, 12B, 12C, 12D and 12E. For purposes of the forces that the roof will encounter from exposure to wind uplift, the roof 12B is divided into different wind zones 301 through 309. For an actual application of the method for providing a roof, the wind zones depicted in FIG. 1 would be determined by applicable building codes, engineering analysis, computer modeling, and empirical tests. However, the mapping of the zones has been simplified in FIGS. 1–3 for the purpose of simplifying the explanation of how the method is applied, and is meant to be an example only.

FIG. 16 provides a table of corresponding letter designations A through F for different types of seaming, with A being the strongest for a continuous quadrilock seam and F being the least strong for a roll-and-lock seam. The table provided in FIG. 17 shows, in column 3, the types of seaming required for the wind zones 301–309. In the areas of greater wind uplift, stronger seam are used.

Water leaks are generally the result of rainfall intensity, wind-driven rainstorms or melting snow or ice that results in dams. The water dams upslope of a snow or ice drift; or as a result of wind forces preventing the water from running freely off the roof, or where water collects because of compound roof slopes or length of run. These conditions can cause water ponding with sufficient water pressure to penetrate the roof. Accordingly, the roofs 12A–12E of the building 10 can be divided into areas more prone to leakage. The water-tightness of such areas may be increased above other areas less likely to leak by selecting the most appropriate seam apparatus for each area.

Figure 2:
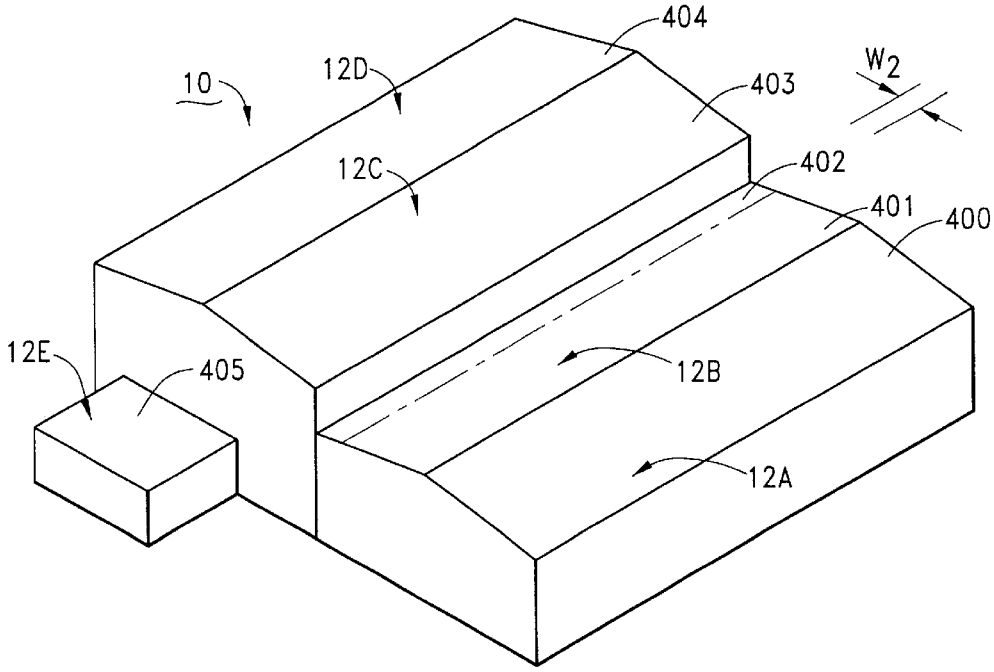
FIG. 2 is a perspective view of the building of FIG. 1, indicating the potential leak zones of the roof that can be critical with regard to invasion of wind-driven rain leaks.

FIG. 2 shows the potential leak zones for roof 12B of building 10. The zone with the greatest potential for a water leak is zone 402, while the zone with the least potential for a water leak is zone 401. The seaming required for each zone is shown in column 5 of the table of FIG. 17.

Snowdrift zones are areas of a roof classified with respect to the tendency of snow to form snowdrifts. The forming of snowdrifts are a problem, not only because of the increased load associated therewith, but also because there is a greater likelihood for water damming, as the snow melts, and related problems.

Figure 3:
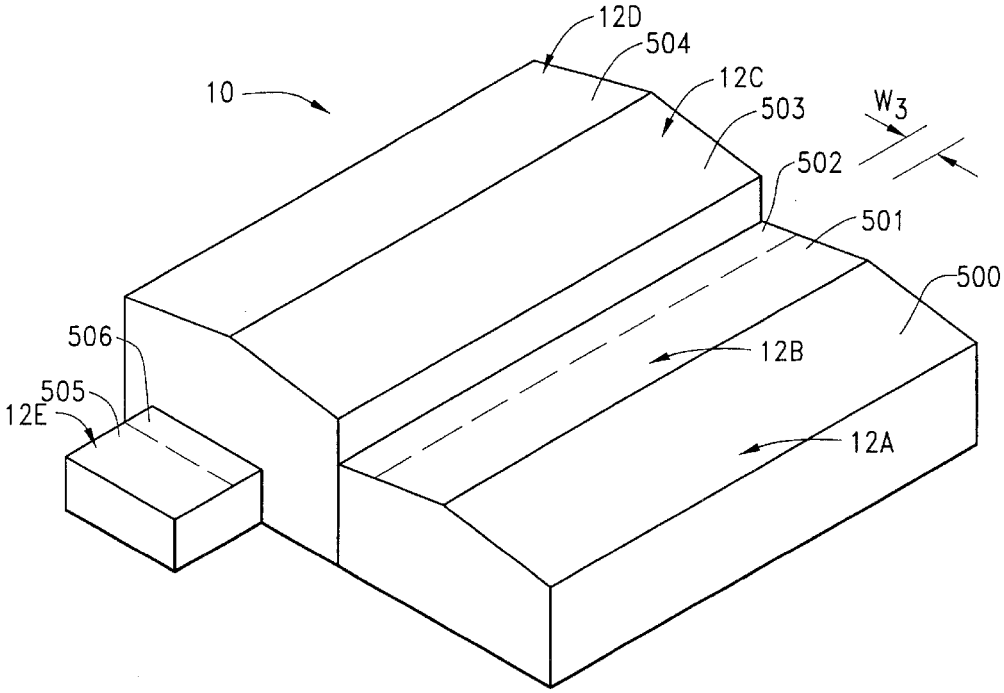
FIG. 3 is a perspective view of the building of FIG. 1, indicating the snowdrift zones of the roof subject to probable snow buildup and the zones having potential water damming with snow melting.

FIG. 3 shows the snowdrift zones for the roof 12B of the building 10. The least potential for a snowdrift is at zone 500, while the greatest potential for a snowdrift is at zone 502. The seaming required for each snowdrift zone is provided in column 7 of the table FIG. 17.

Figure 4:
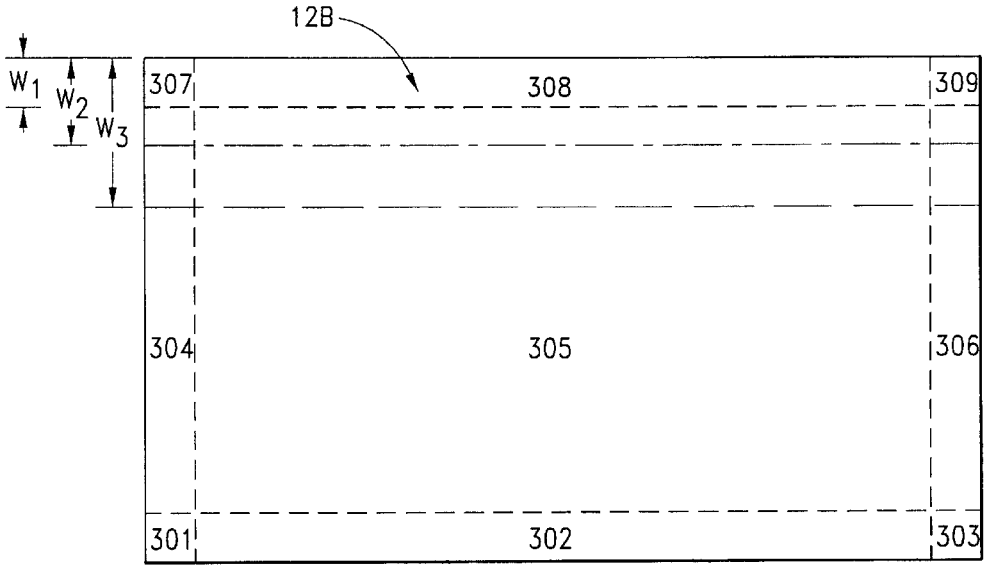
FIG. 4 is a top view of roof 12B of FIG. 1, indicating the wind zones of the roof corresponding to different amounts of wind uplift force.
Figure 5:
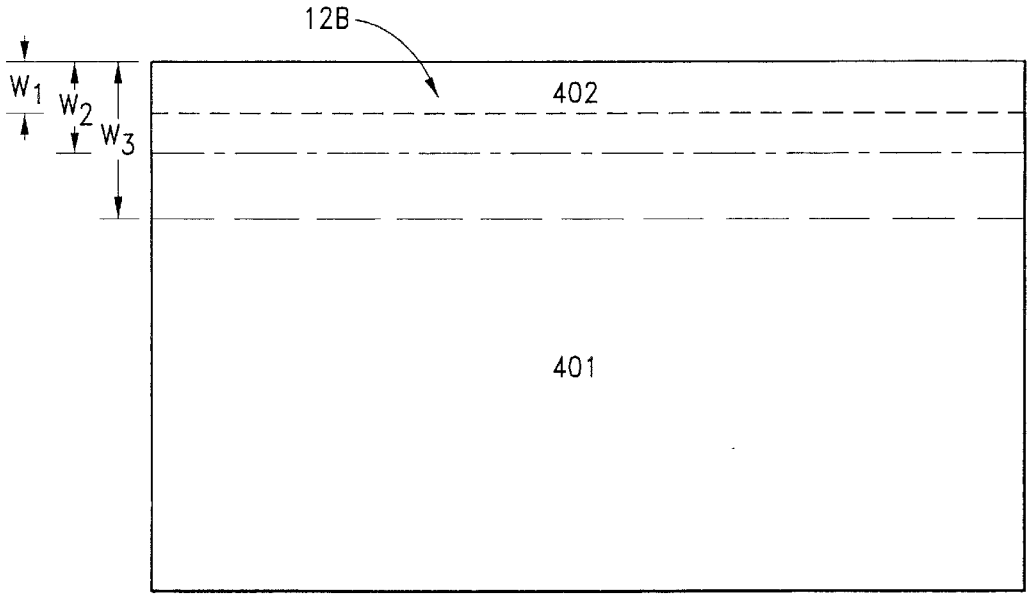
FIG. 5 is a top view of roof 12B shown in FIG. 1, indicating the potential leak zones critical with regard to invasion of wind-driven rain leaks.
Figure 5:
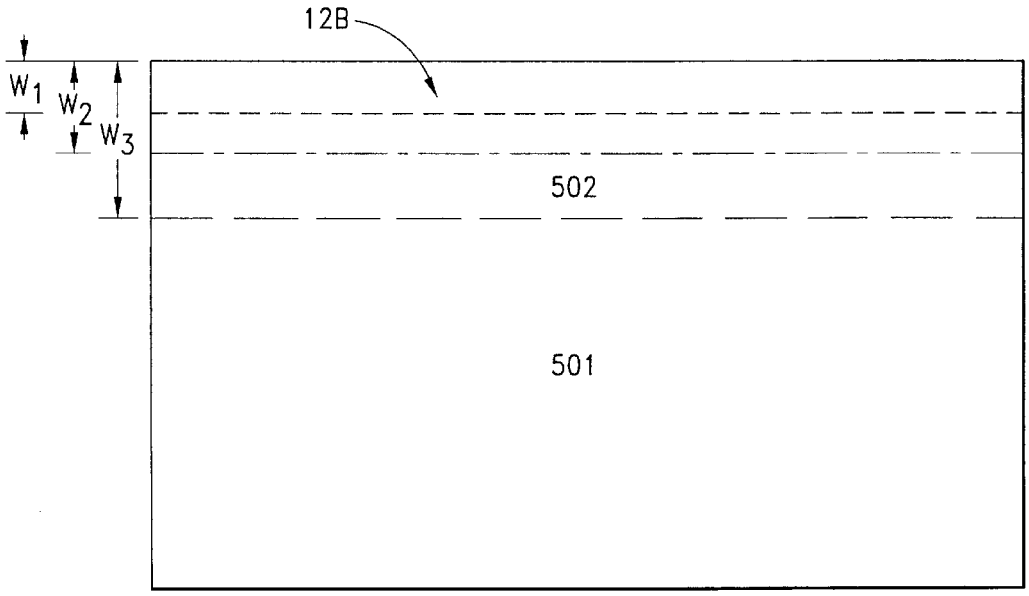
Figure 7:
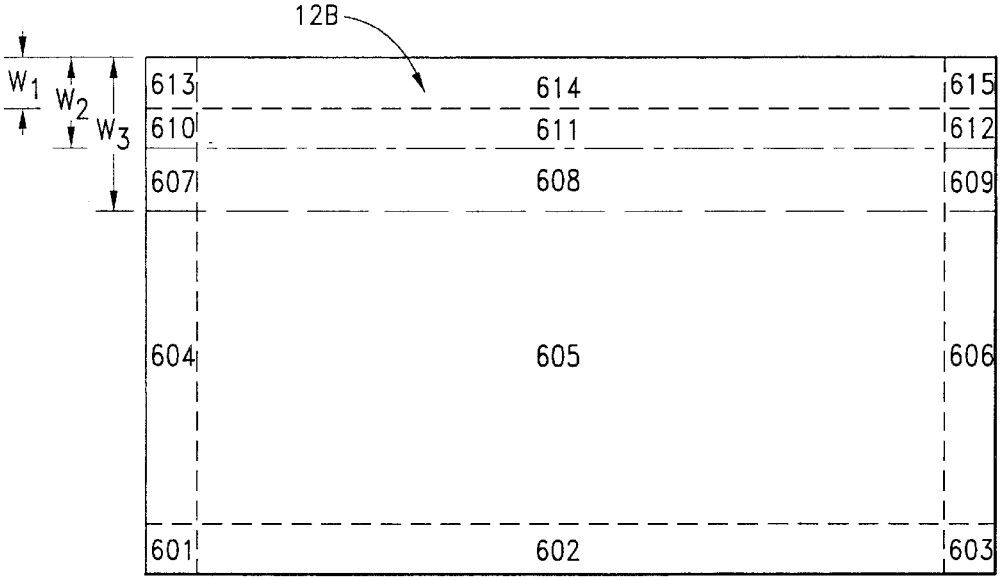
FIG. 7 is a top view of roof 12B shown in FIG. 1, showing a composite mapping of the zones mapped individually in FIGS. 4–6.

FIGS. 4–6 are detailed top views of the demand zones shown in FIGS. 1–3 for the roof 12B of the building 10. FIG. 7 is a composite mapping of the various detailed demand zones shown in FIGS. 4–6. This type of composite mapping must be prepared so that one knows where all the demand zones lie with respect to one another and with respect to the physical dimensions of the roof. The zones produced by the composite map of FIG. 7 are called composite zones, and are listed in column 1 of the table of FIG. 17. The seams chosen to satisfy all the minimum requirements of the different demand zones are referred to as composite seams and are listed in column 8 of the table of FIG. 17.

To determine the composite seam chosen for a particular composite zone, one first examines the seams chosen for the wind zone, the leak zone, and the snowdrift zone. Then, the composite seam is chosen to be the least expensive seam that will meet the requirements of all the functional requirements of these demand zones. For example, as related to seam strength, and as depicted in the table of FIG. 16, the strongest seam is a quadrilock seam (A) and the weakest seam is the roll-and-lock seam (F).

For example, referring again to the table of FIG. 17, composite zone 608 requires: (1) a combination elastic-and-triple-lock seam E to meet the minimum requirements for the wind zone 305; (2) a roll-and-lock seam F to meet the minimum requirements of the leak zone 401; and (3) a triple-lock seam C to meet the minimum requirements of the snowdrift zone 502. To meet the requirements of all three demand zones, the snowdrift zone 502 is controlling. Thus, the triple-lock seam C is used the triple-lock seam C being of higher seam quality that of seams E and F.

The selection of seaming processes to match the various demand zones depicted in the table of FIG. 17 is meant to be an example only. The actual seaming process chosen for a roof depends on many variables including prevailing wind data, the height of the building, the shape and slope of the roof, the nearness to other structures, and the occupancy of the building.

In the past, when a contractor provided a roof to meet different demand zones, the contractor had to either: (1) over-design portions of the roof to meet the most stringent demand zone, or (2) order different panel widths or material thickness of metal roof panels for the different zones. In the case of over-designing the roof, the contractor would look at mappings such as shown in FIGS. 4–6 and the table of FIG. 17, and require that all the seams be seamed by a continuous quadrilock process. This greatly increased the cost of the roof. If the contractor chose to use different materials in different zones, that greatly added to the cost of the roof because different materials often require different types of roll-forming tools that have to be made available at the job site.

The present invention provides a universally acceptable metal roof panel that can be utilized to form all of the zones of the roofs 12A–12E depicted in FIGS. 1 through 3 and discussed above. That is, a universally acceptable metal roof panel can be adapted to meet the varying loading requirements for all of the zones of the roofs 12, 12A and 12B.

Figure 8:
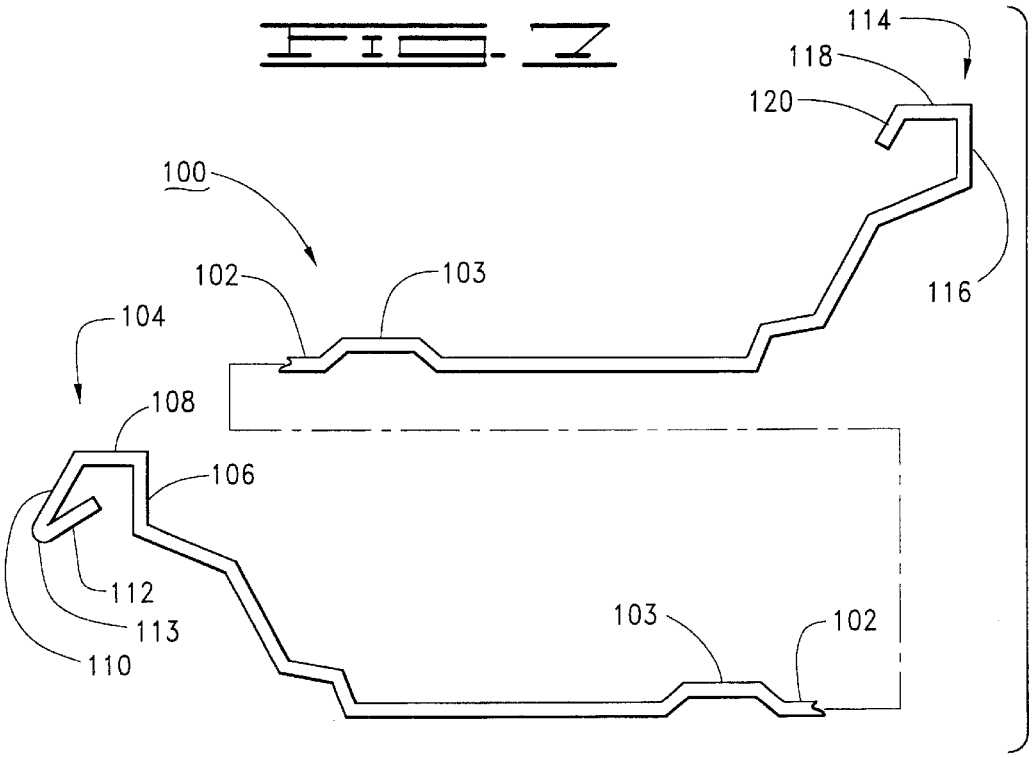
FIG. 8 is an elevation end view of a universal roof panel constructed in accordance with the present invention.

Such a universal panel will now be described with reference to FIGS. 8 through 14. Shown in FIG. 8 is a metal roof panel 100 having a substantially flat medial portion 102, the medial portion 102 having a pair of corrugations 103 that serves to strengthen the panel 100. Although the particular examples embodiment shown has corrugations, the corrugations are considered optional features.

The panel 100 has a first female sidelap 104 formed with a first vertical trunk 106 and a first leg 108 extending from the first vertical trunk 106. A first foreleg 110 with a hook 112 extends from the first leg 108. The hook 112 has a base 113.

A second male sidelap 114 of the panel 100 has a second vertical trunk 116 and a second leg 118 extending therefrom. A second foreleg 120 extends, as shown, from the second leg 118.

Figure 9:
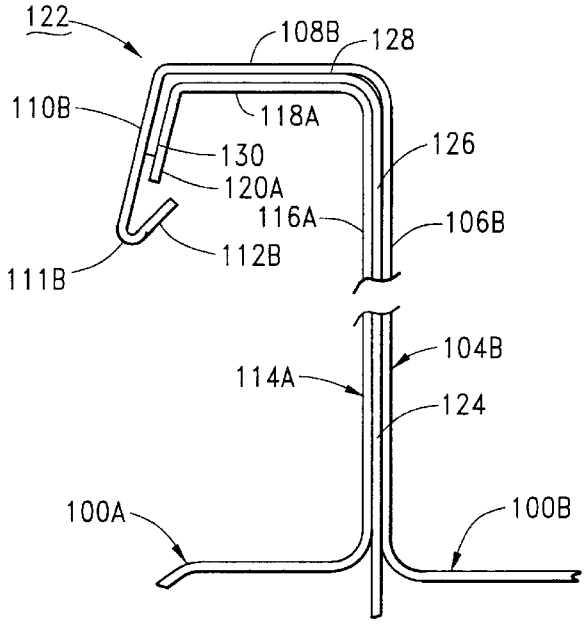
FIG. 9 is an elevation end, view of an interlocked pair of the roof panel of FIG. 8, showing a portion of a clip secured thereto.

Shown in FIG. 9 is an interlocking joint 122 formed by adjacently disposed two roof panels 100A and 100B identical in construction to the roof panel 100 above described, and a clip tab 124 (shown in part) is disposed therebetween. As will be understood, the roof panels 100A, 100B (shown in part) and the clip tab 124 are supported by, and attach to, underlying support members, such as purlins (not shown).

The second male sidelap I 14A of the roof panel 100A has a second trunk 116A and a second leg 18A extending from the second vertical trunk 116A, and the second foreleg 120A extends from the second leg 118A. The first female sidelap 104B of the roof panel 100B includes the first vertical trunk 106B and a first leg 108B extending therefrom. A first foreleg 110B with a hook 112B and base 113B extends from the first leg 108B.

The clip tab 124, disposed between the second male sidelap 114A (of the roof panel 100A) and the first female sidelap 104B (of the roof panel 100B), has a trunk 126 and an extending clip leg 128 extending therefrom. As noted above, the clip tab 124 is secured via a clip base (not shown) to the underlying support structure of the building. In an actual installation, multiple clips identical to the clip tabs 124 are disposed at spaced apart intervals along the joint 122.

Figure 10:
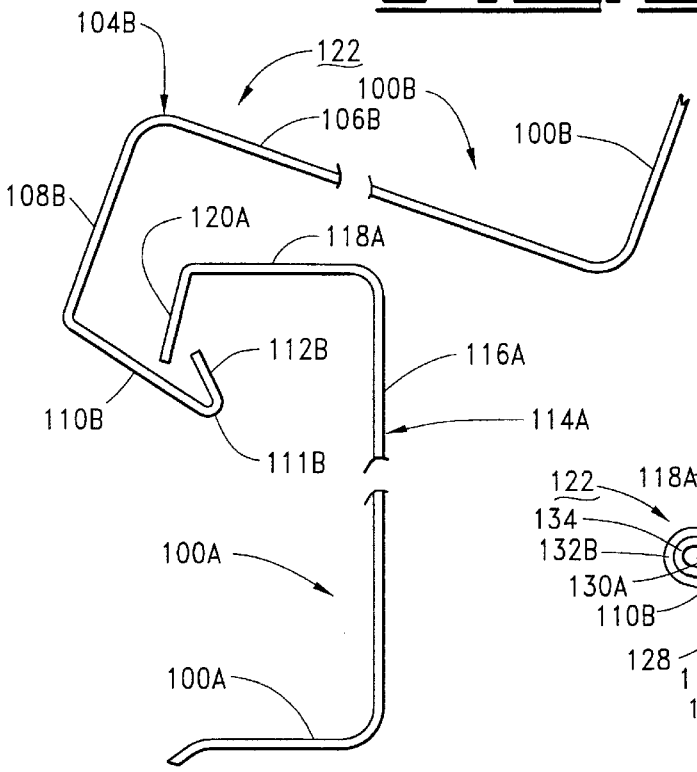
FIG. 10 is a first elevational end view of the panels of FIG. 8, showing the roll-and-lock seam thereof as the panels are being assembled.

FIGS. 10–12 illustrate how the two roof panels 100A and 100B are assembled. In FIG. 10, workmen have secured the first roof panel 100A in its stationary position and lifted and disposed the second roof panel 100B to engage the first roof panel 100A. In the position shown in FIG. 10, the workmen have raised and positioned the second panel 100B so that the hook 112B is about to engage the second foreleg 120A. The workmen use the point of contact (in the two-dimensional view) of the hook 112B and the second foreleg 120A as an axis of rotation to lower the second panel 100B. In the intermediate position shown in FIG. 11, the second panel 100B has been rotated downwardly to the point where the second foreleg 120A is positioned in a slot defined by the hook 112B, the base 111B and the first foreleg 120B. As shown in FIG. 12, the workmen continue to rotate the second panel 100B until the flat medial portion 102B (not shown) is supported by the roof support structure.

The seam shown in FIG. 12 is referred to as a roll-and-lock-seam, with roll referring to the rotation process described above that workmen use to engage the two panels 100A and 100B. As shown in FIG. 12, no permanent deformation has occurred. That is, the shapes of the sidelaps 114A and 104B of the roof panels 100A and 100B are substantially the same as when originally formed. The locking action occurs from elastic deformation of the panel sidelaps 114A and 104B to engage one another, gripping the clip tab 124 therebetween. The roll-and-lock seam is also referred to as an elastically locked seam. Typically, the roll-and-lock seam, and all other seams described herein, are further sealed from water penetration by a joint sealant (not shown).

Figure 13:
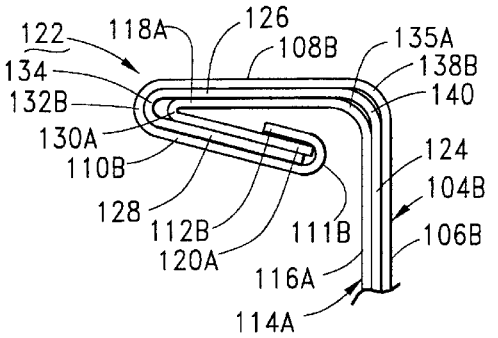
FIG. 13 is an elevation end view of the panels of FIG. 8 with a clip secured thereto and having been seamed to form a multiple-lock seam in accordance with the present invention.

In FIG. 13, a detailed view is shown of clip tab 124 disposed between the second male sidelap 114A of the first panel 100A and the first female sidelap 104B of the second panel 100B. A bending tool has been used to simultaneously bend the second male sidelap 114A of the first panel 100A, the clip tab 124, and the first female sidelap 104B of the second panel 100B at first panel elbow 130A, second panel elbow 132B and clip elbow 134. The bending of these parts together causes non-elastic, or plastic, deformation of each part and acts to form a secure connection between the first panel 100A, the second panel 100B and the clip tab 124.

Non-elastic deformation refers to bending that stresses portions of the material to a point beyond the yield point so that the material remains deformed after the stress has been removed. The seam shown in FIG. 13 represents a triple-lock seam formed by a triple-lock seaming process.

In FIG. 14, a detailed view is shown of the clip tab 124 disposed between the second male sidelap 114A of the first panel 100A and the first female sidelap 104B of the second panel 100B. A bending tool has been used to simultaneously bend the second foreleg 120A with respect to second leg 118A, to bend the clip foreleg 126 with respect to the clip leg 128, and to bend the first foreleg 100B with respect to the first leg 108B. This first bending action occurs at the second elbow 130A, the first elbow 132B, and the clip elbow 134. A bending tool has also been used to form a second bend at a first panel second shoulder 136, a second panel first shoulder 138B and a clip shoulder 140. In the second bending action, the second leg 118A is bent with respect to the second trunk 116A, the first leg 108B is bent with respect to the first trunk 106B, and the clip leg 126 is bent with respect to the clip trunk. The seam shown in FIG. 14 is referred to as a quadrilock seam formed by a quadrilock seaming process.

For the triple-lock and the quadrilock seaming processes, there are two options for each process. The first option is to continuously form triple-lock or quadrilock seams along a sidelap of a panel run. As used herein, a panel run is a column length of panels positioned adjacent each other along a line on the roof running from an eave to a peak. The second option is to form triple-lock or quadrilock seams at the clips, but to leave the lengths between the seamed portions with a roll-and-lock seam.

Where triple-lock seams are formed at the clips, or in short segments along a joint, and has roll-and-lock seams elsewhere, this type of seaming is called combination elastic-and-triple-lock seaming, or intermittent triple-lock seaming. Where quadrilock seams are formed at the clips, or in short segments along a joint, and has roll-and-lock seams elsewhere, this type of seaming is called combination elastic-and-quadrilock seaming or intermittent quadrilock seaming. Where continuous triple-lock seams are used with quadrilock seams at the clips, this type of seaming is called combination triple-lock-and-quadrilock seaming.

A given segment of a sidelap joint can be adjusted to a number of wind uplift and water-tightness performance levels by using different seams. That is, a sidelap joint, depending in which zone it is disposed, is formed by the appropriate one of the following:

(1) a quadrilock seam in the eave area where high wind loads occur;

(2) a triple-lock seam up higher on the roof where lesser wind loads occur;

(3) combination elastic-and triple-lock, combination elastic-and-quadrilock, and combination triple-lock-and-quadrilock seams even higher on the roof; and (4) for the rest of the roof, simply a roll-and-lock seam.

Regarding water-tightness, a quadrilock seam may be used in heavy snowdrift areas where water-tightness is particularly important. Other types of seams may be used in less demanding areas for water-tightness.

Generally, the more work energy that must be used on the roof to form a given seam, the more costly and complex is the seaming process, and more the seam is subject to malfunction. The relative work energy and skill required to seam the panels varies from the highest for continuous quadrilock to the lowest for roll-and-lock. The cost generally parallels the relative work energy required to seam the panels together.

Figure 15:
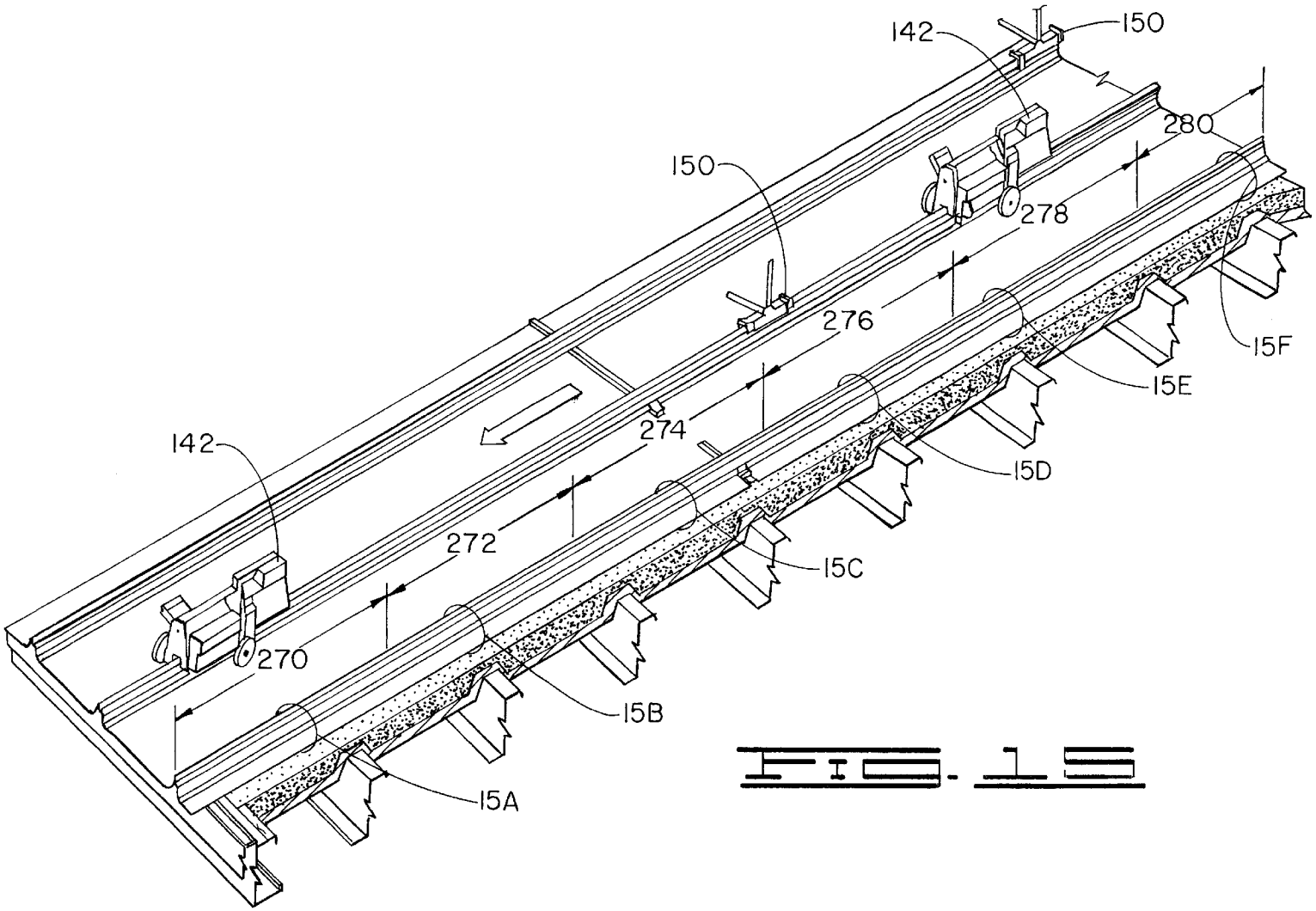
FIG. 15 is a perspective view of two adjacent roof panels, a motorized seamer, and a hand seamer in operation to practice the present invention.
Figure 15A:
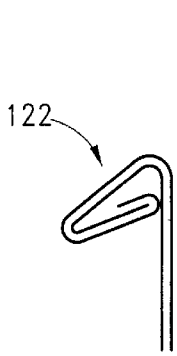
FIG. 15A depicts a quadrilock seam profile corresponding to the detail 15A shown in FIG. 15 without a clip attached thereto.

FIG. 15 shows a schematic representation of a motorized seamer 142 and a hand-operated seamer 150 on a metal roof. The motorized seamer 142 is typically used for lengthy runs of continuous seaming. The hand-operated seamer is typically used near the eave, at the ridge and, when desired, at the clips. In some areas of the roof, it is only necessary to have triple-lock seams or quadrilock seams at the clips. The use of continuous seams in these areas of the roof unnecessarily increases the cost of manpower and equipment in providing the roof.

The motorized seamer 142 is used to form a continuous seam along a substantial length of a roof section, and it typically operates by forming a triple-lock on a first pass along the length of a seam. The motorized seamer 142 produces a quadrilock seam by making a second pass along the same seam where a triple-lock has first been formed using a different roll tool.

As shown in FIG. 15, different seams have been used to achieve different roof quality levels. A section 270 uses a quadrilock seam for its full length because it is subject to large wind uplift forces or watertightness requirements. In the next area up the roof, designated as 272, a combination triple-lock-and-quadrilock seam is used because the wind uplift forces are lower than in the areas below it. In the next area up the roof, designated as 274, a continuous triple-lock seam is used because the wind uplift forces are lower than in the areas below it.

In the next area up the roof, designated as 276, a combination elastic-and-quadrilock seam is used because the wind uplift forces are lower than in the areas below it. In the next area up the roof, designated as 278, a combination elastic-and-triple-lock seam is used because the wind uplift forces are lower than in the areas below it. Finally, in the next area up the roof, designated as 280, the wind uplift forces are the lowest and a roll-and-lock seam is used.

FIG. 15 illustrates how different seams may be used where one encounters different wind uplift forces. Many different seams may be used in many different patterns to most economically meet performance requirements of the different demand zones.

Figure 15B:
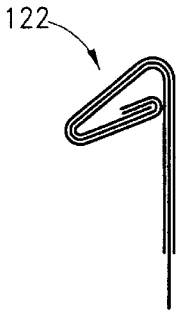
FIG. 15B depicts a combination triple-lock-and-quadrilock seam profile corresponding to the detail 15B shown in FIG. 15, for which there is continuous triple-lock seaming with quadrilock seaming at the clips.
Figure 15C:
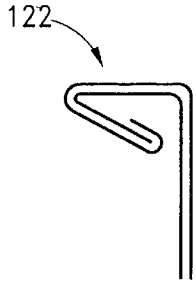
FIG. 15C depicts a triple-lock seam profile corresponding to the detail 15B shown in FIG. 15.
Figure 15D:
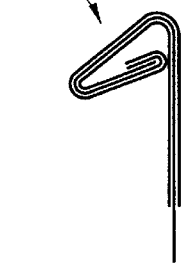
FIG. 15D depicts a combination elastic-and-quadrilock seam profile corresponding to the detail 15D shown in FIG. 15, for which there is a roll-and-lock seam with a quadrilock seam at the clips.
Figure 15E:
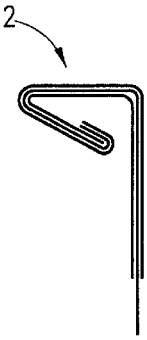
FIG. 15E depicts a combination elastic-and-triple-lock seam profile corresponding to the detail 15E shown in FIG. 15, for which there is a roll-and-lock seam with a triple-lock seam at the clips.
Figure 15F:
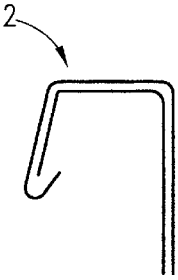
FIG. 15F depicts a roll-and-lock seam profile corresponding to the detail 15F shown in FIG. 15.

FIGS. 15A–15F depict the profiles of types of seaming corresponding to the details shown in FIG. 15, where FIG. 15B, FIG. 15D and FIG. 15E are shown where the panels connect to the clips.

FIGS. 18 and 19 provide value/cost charts depicting relative wind uplift resistance and watertightness performance, respectively, of different seams in order of increasing cost. These can be used to select the lowest cost level that achieve a required level of performance, other factors being equal, after other required steps have been completed.

The relative roof performance of the different seams may be determined by simulated wind uplift, watertightness and other tests or by analytical means so that they may be used in different areas as appropriate to their cost and performance. The relative in-place cost of each type of seam may be determined for a given roof by means of a cost analysis. It not being necessary to determine the absolute cost, the relative cost will serve to insure the appropriate seam with the minimum cost is chosen and used.

As an example, continuous quadrilock will normally be the most expensive, the cost of the metal roof panel, transportation to the job site and costs other than seaming being equal. This is logical in that quadrilock seams require more work/energy to seam than any of the other seams. The quadrilock seams also require more time to form and are more subject to delays and problems. The quadrilock seams require much greater attention to detail.

On the other hand, the roll and lock seam only requires a relatively simple direct elastic assembly and it will cost less than the other seams. The intermittent quadrilock seam, the intermittent triple-lock seam and the continuous triple-lock seam will cost somewhere between the two extremes. Normally the continuous triple-lock seam that requires a relatively expensive on the roof seaming machine, an electrical source and related paraphernalia will cost less than the quadrilock seam, but more than the intermittent quadrilock seam, which at most requires a hand crimp machine to crimp only required portions of the joint between the metal roof panels. The intermittent triple-lock seam requires less work energy than the intermittent quadrilock seam, but more than the simple roll and lock seam.

The relative cost of these seams, other things being equal, will contain the amortization, maintenance and administrative cost of the seaming equipment and the erection time of the person seaming the roof. Power seamers of the type required for this operation normally cost in the $4,000–$8,000 range and require regular periodic maintenance; and there is a considerable administrative cost in scheduling and shipping to and from the job site. Hand crimpers are much less costly, ranging from about $100 to $200 each, and are easier to ship and maintain.

Labor costs to seam the panels vary widely depending on a number of geographic, and union factors. For example, .such costs can range from a low in some non-union projects to a high in some union or government projects. Thus, the importance of seamer and labor costs may vary for each project and are dependent on the erection procedure, equipment and personnel required to transport, place and install the panels on the roof. A suitable method of selecting the lowest cost seam that meets the requirements of the roof zone under consideration may be achieved using tables as shown in FIGS. 18 and 19. Similar tables to those shown FIGS. 18 and 19 may be constructed to represent a cost/function for other performance characteristics.

In building roof construction, it is generally accepted that all roofs leak or structurally fail under severe conditions. Thus, it becomes a matter of establishing the degree of watertightness, live load, wind uplift resistance, diaphragm strength, roof aesthetics or other criteria required in a given set of circumstances for each appropriate section of the roof. Following this, the best combination of roof features is selected to achieve the desired quality at a minimum cost level. Any one or any combination of performance criteria can be chosen as the ones to construct at least cost.

The method for providing a metal roof for a building begins by identifying and mapping wind zones of the roof. Next, the type of seaming to be utilized is selected for different wind zones of the roof Next, the metal panels are installed on the roof support structure, using fasteners to secure the panels to underlying roof support members. When installing the metal panels, the panels-are elastically seamed together by the roll-and-lock seam. Finally, the selected process for each pair of metal panels is used to seam every adjacently engaged panel.

Thus, the lowest cost seam that meets the requirement for wind uplift in the zone under consideration will be employed unless the zone is controlled by other considerations such as watertightness.

With regard to watertightness, commercial building roofs can be divided into those areas most likely to leak and consequently requiring the most watertight roof seam. Generally, the roll-and-lock will be the most likely seam to leak under adverse conditions; the combination elastic-and-triple-lock seam will be more water resistant; and the continuous quadrilock seam will be the most water resistant.

The chart of FIG. 19 provides a watertightness value/cost comparison denoting a series of seams with different resistance to water penetration ranked in order of increasing cost.

Although the steps of the method of the invention are described and claimed in a particular order, there is no reason that some of the steps cannot be performed in a different order. For example, one can install all the panels, then identify and map the wind zones of the roof. No ordering of the steps should be implied from the order in which the steps are presented. Only those steps which inherently require order should be inferred from the order in which the steps have been presented or claimed. For example, one has to choose which seaming process one wishes to use before seaming the side-adjacent panels together.

The present invention provides a zone based roofing system for providing a roof made from- panels seamed together by various selected seaming processes to provide designated strength for each zone of the roof. While particular embodiments have been presented by way of illustration, it is understood that such embodiments are illustrative, and not restrictive. Thus, changes and modifications may be made without departing from the spirit and scope of the invention as defined by the claims that follow.

What is claimed is:

1. A method for providing a metal roof for a building having a roof support structure, the roof having a plurality of demand zones, the method comprising:

(a) identifying and mapping the demand zones of the roof;

(b) installing metal panels on the roof support structure, covering the roof support structure with metal panels, wherein the metal panels are elastically seamed together;

(c) choosing a seaming process for further connecting every panel to a side-adjacent panel, wherein a different seaming process is selected for each demand zone to produce a seam that satisfies the performance requirements of that particular demand zone; and (d) seaming the metal panels according to the process chosen in step (c).

2. The method of claim 1 wherein the demand zones of step (a) comprise:

(i) wind zones;

(ii) potential leak zones; and (iii) snowdrift zones.

3. The method of claim 2 wherein step (c) comprises the substeps:

(i) determining the seaming requirements for the demand zones of the roof in which the particular panel happens to lie;

(ii) determining the seaming requirements from prevailing wind data for a specific geographic area in which the roof is located;

(iii) determining the seaming requirements of local building codes for the specific geographic area; and (iv) ensuring that the method of seaming chosen for the particular panel satisfies the requirements of the demand zones, the prevailing wind data, and the local building codes.

4. The method of claim 1 wherein the process for further connecting every panel to side-adjacent panels is chosen from a class of seaming processes consisting of:

(a) no additional seaming;

(b) triple-lock seaming;

(c) quadrilock seaming;

(d) combination elastic-and-triple-lock seaming;

(e) combination elastic-and-quadrilock seaming; and (f) combination triple-lock and quadrilock seaming.

5. A method for providing a metal roof for a building, the building having a roof support structure, the method comprising:

(a) identifying and mapping demand zones of the roof;

(b) determining the seaming requirements for each demand zone;

(c) choosing a process for seaming a particular panel to a panel which is side-adjacent to the particular panel, wherein a different seaming process is selected for each demand zone to produce a seam that satisfies the performance requirements of that particular demand zone; and (d) installing metal panels on the roof support structure, covering the roof support structure with metal panels; and (e) seaming together any two side-adjacent panels by an elastically locked seam.

6. The method of claim 5 wherein the demand zones of step (a) are wind zones, potential leak zones, and snowdrift zones.

7. The method of claim 5 further comprising the step of forming a continuous triple-lock seam in demand zones identified as requiring a triple-lock seam or a quadrilock seam.

8. The method of claim 7 further comprising the step of forming combination triple-lock and quadrilock seams in demand zones requiring combination triple-lock and quadrilock seams.

9. The method of claim 5 further comprising the step of forming combination elastic-and-triple-lock seams in demand zones identified as requiring combination elastic-and-triple-lock seams.

10. The method of claim 9 further comprising the step of forming combination elastic-and-quadrilock seams in demand zones identified as requiring combination elastic-and-quadrilock seams.

11. The method of claim 9 further comprising the step of forming continuous quadrilock seams in demand zones requiring continuous quadrilock seams.

12. The method of claim 5 wherein step (c) comprises the substeps:

(i) determining the seaming requirements for the demand zones of the roof in which the particular panel happens to lie;

(ii) determining the seaming requirements from prevailing wind data for a specific geographic area in which the roof is located;

(iii) determining the seaming requirements of local building codes for the specific geographic area; and (iv) ensuring that the method of seaming chosen for the particular panel satisfies the requirements of the demand zones, the prevailing wind data, and the local building codes.

13. For a metal panel roof having side-adjacent metal panels positioned on a roof, a method of connecting each pair of the side-adjacent panels to one another, comprising:

(a) elastically seaming the side-adjacent panels together; and (b) further connecting at least one other pair of side-adjacent panels by an inelastic seaming process chosen from a class of seaming processes consisting of:
(i) triple-lock seaming;
(ii) quadrilock seaming;
(iii) combination elastic-and-triple-lock seaming;
(iv) combination elastic-and-quadrilock seaming; and
(v) combination triple-lock and quadrilock seaming.

14. The method of claim 13 wherein both the elastic seaming process and the inelastic seaming process occur at one of two sidelaps of the panel along a panel run.

15. A metal panel roof comprising metal panels joined by:

(a) an elastic seaming process; and (b) an inelastic seaming process chosen from a class of inelastic seaming processes consisting of:
(i) triple lock seaming;
(ii) quadrilock seaming;
(iii) combination elastic and triple-lock seaming;
(iv) combination elastic-and-quadrilock seaming; and
(v) combination triple-lock and quadrilock seaming.

16. The metal panel roof of claim 15 wherein both the elastic seaming process and the inelastic seaming process occur at one of two sidelaps of the panel along a panel run.

17. A method for providing a metal roof of a building having a roof support structure, the roof having a plurality of demand zones, the method comprising:

(a) identifying and mapping demand zones of at least one roof function of the roof;

(b) installing roofing panels on the roof support structure, the roofing panels being elastically seamed together;

(c) choosing a seaming process for further connecting at least some of the panels to side-adjacent panels, wherein a different seaming process is selected for at least two different demand zones, each selected seaming process producing a seam that satisfies the performance requirements of the respective demand zones; and (d) seaming the metal panels according to the process chosen in step (c).

18. The method of claim 17 wherein one of the roof functions is wind uplift load.

19. The method of claim 17 wherein one of the roof functions is water tightness.

20. The method of claim 17 wherein one of the roof functions is wind uplift and another of the roof functions is water tightness.

21. A method of providing a metal roof for a building having a roof support structure, the roof having a plurality of demand zones, the method comprising:

(a) identifying and mapping the demand zones of at least a portion of the roof for roof functions;

(b) elastically joining the side-adjacent panels together; and (c) further connecting at least some of the side-adjacent panels by a different seaming process chosen from a class of seaming processes consisting of:
(i) triple-lock seaming;
(ii) quadrilock seaming;
(iii) combination elastic-and-triple-lock seaming;
(iv) combination elastic-and-quadrilock seaming; and
(v) combination triple-lock and quadrilock seaming.

22. The method of claim 21 wherein one of the roof functions is wind uplift load.

23. The method of claim 21 wherein one of the roof functions is water tightness.

24. The method of claim 21 wherein one of the roof functions is wind uplift and another of the roof functions is water tightness.

* * * * *